United States Patent [19]

Asano et al.

[11] 4,259,940

[45] Apr. 7, 1981

[54] GRINDING MACHINE WITH A CBN GRINDING WHEEL

[75] Inventors: Hiroaki Asano, Chiryu; Toshio Maruyama, Kariya, both of Japan

[73] Assignee: Toyoda Koki Kabushiki Kaisha, Aichi, Japan

[21] Appl. No.: 70,398

[22] Filed: Aug. 28, 1979

[30] Foreign Application Priority Data

Sep. 5, 1978 [JP] Japan ..... 53-108924

[51] Int. Cl.[3] ..... B24B 53/04

[52] U.S. Cl. ..... 125/11 CD; 51/259

[58] Field of Search ..... 125/11 R, 11 CD; 51/259

[56] References Cited

U.S. PATENT DOCUMENTS

| | | | |
|---|---|---|---|
| 2,623,333 | 12/1952 | Baldenhofer | 125/11 CD |
| 4,068,416 | 1/1978 | Bonnice | 125/11 CD |
| 4,073,281 | 2/1978 | Asaeda | 125/11 CD |
| 4,151,684 | 5/1979 | Wada | 125/11 CD |

*Primary Examiner*—Harold D. Whitehead

*Attorney, Agent, or Firm*—Oblon, Fisher, Spivak, McClelland & Maier

[57] ABSTRACT

A grinding machine wherein a novel arrangement is provided to effect truing and dressing on a surface of a grinding wheel made of hard material such as cubic boron nitride. The arrangement comprises a truing wheel coaxially fixed on one end of a work head spindle of the grinding machine for truing the grinding wheel surface and a dressing roll coaxially fixed on one end of the work head spindle in juxtaposed relation with the truing wheel for backing up free abrasive grains supplied between the grinding wheel and the dressing roll during dressing.

2 Claims, 4 Drawing Figures

10
11
12
13
14
15
16
17
20
21
22
23
24
25
37
38
39
40
41
42
43
II
II

GRINDING MACHINE WITH A CBN GRINDING WHEEL

BACKGROUND OF THE INVENTION

1. Field of the Invention

The present invention relates to a grinding machine having arrangements for effecting truing and dressing of a grinding wheel made of hard material such as cubic boron nitride.

2. Description of the Prior Art

There has been known a grinding machine having a device for truing and dressing a so-called "CBN grinding wheel" in which cubic boron nitride abrasive grains are bonded on a circumferential surface of a metallic disc in the form of a stratum. Generally, such a truing and dressing device is composed of a truing wheel for truing the CBN grinding wheel, a dressing roll for backing up free abrasive grains acting as dressing agent, and a drive motor for rotating the truing wheel and the dressing roll and is disposed, as a solely completed device, either upon a work table or upon a wheel head. Therefore, there remains unsolved a problem in the respect that the cost of a grinding machine with such a complete truing and dressing device is increased.

SUMMARY OF THE INVENTION

Accordingly, it is a primary object of the present invention to provide an improved grinding machine which is simple in construction and is lower in cost by utilizing as the mechanisms for performing the truing and dressing of a CBN wheel a part of a plurality of mechanisms that the grinding machine already has for grinding workpieces.

This object is achieved according to the present invention through the provision of a grinding machine, in which a truing wheel and a dressing roll are coaxially fixed on a work support shaft of a work head in juxtaposed relation with each other. A traverse feed mechanism for feeding a traverse table on which the work head is mounted is utilized to selectively bring the truing wheel and the dressing roll into alignment with the grinding wheel. A wheel feed mechanism for feeding a wheel head is utilized to infeed a grinding wheel against the truing wheel so as to establish between the dressing roll and the grinding wheel a gap of a predetermined distance toward which free abrasive grains acting as a dressing agent are supplied. A work drive motor for rotating a workpiece carried by the work support shaft is utilized to rotate the truing wheel and the dressing roll. Further, one of the truing wheel and dressing roll also acts as a face plate of the work head. Accordingly, the grinding machine according to the present invention is simple in construction and is lower in cost as compared with those known grinding machines having a complete truing and dressing device.

BRIEF DESCRIPTION OF THE DRAWINGS

Various other objects, features and attendant advantages of the present invention will readily be appreciated as the same becomes better understood by reference to the following detailed description when considered in connection with the accompanying drawings, wherein like reference numerals designate like or corresponding parts throughout the several views, and wherein.

DETAILED DESCRIPTION OF THE PREFERRED EMBODIMENT

Figure 1:
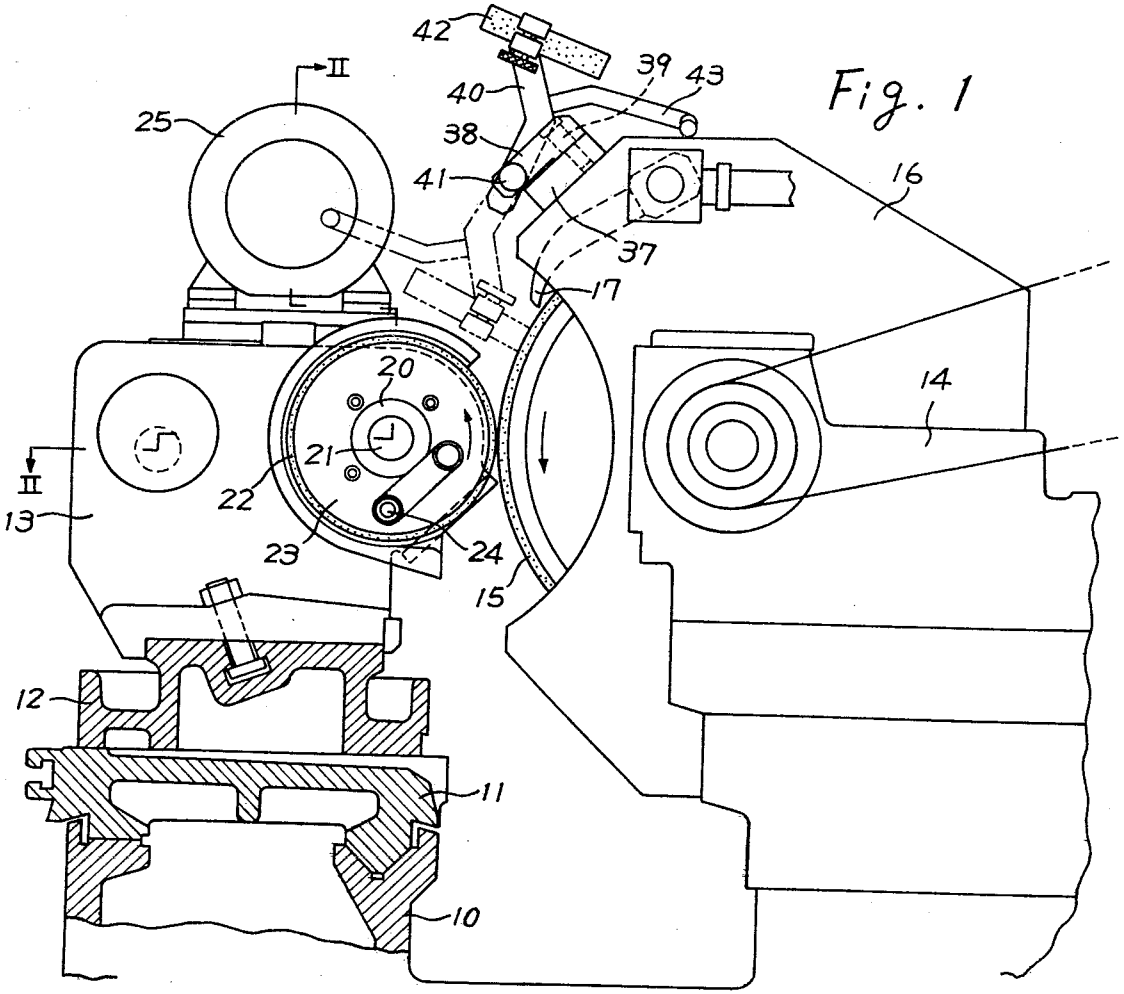
FIG. 1 is a side elevational view partly in section of a grinding machine according to the present invention.
Figure 2:
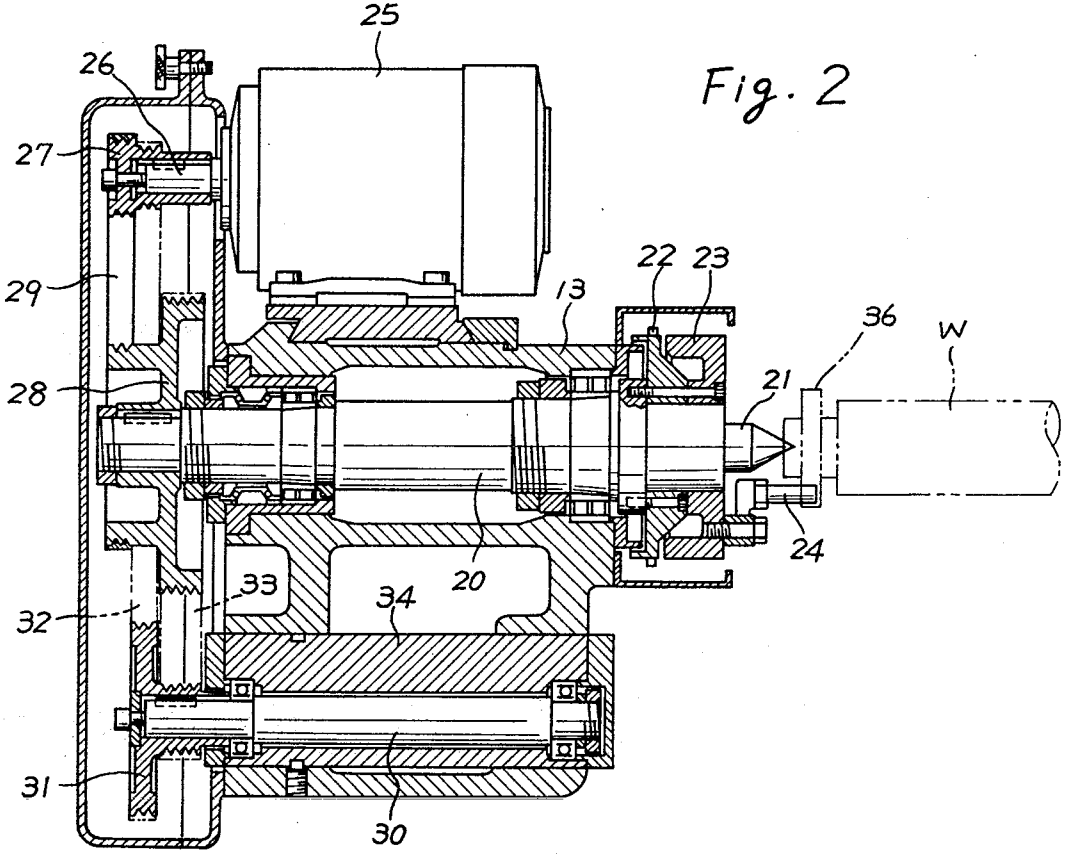
FIG. 2 is an enlarged sectional view of the apparatus, taken along the line II—II of FIG. 1.

Referring now to the drawings and particularly, to FIGS. 1 and 2 thereof, a reference numeral 10 denotes the bed of a grinding machine, on which a traverse table 11 is guided for slide movement. A traverse feed mechanism, not shown, is provided for controlling the movement of the table 11. On the traverse table 11, there is pivotally adjustably mounted a swivel table 12, on which a work head 13 and a foot stock, not shown, are in turn mounted with a predetermined interval. Further, a wheel head 14 is mounted on the bed 10 for forward and retraction movement in a direction transverse to the slide movement of the traverse table 11. A wheel feed mechanism, not shown, is provided for controlling the movement of the wheel head 14. The wheel head 14 rotatably carries a CBN wheel 15 made of cubic boron nitride abrasive material which is bonded on a circumferential surface of an aluminum disc. A wheel drive motor, not shown, is mounted on the wheel head 14 for rotating the CBN grinding wheel 15 in a usual manner in a direction indicated by the arrow in FIG. 1. A wheel cover 16 for housing the grinding wheel 15 is fixed on one lateral surface of the wheel head 14, and within the cover 16 and at the upper portion thereof, there is attached a coolant nozzle 17 for ejecting coolant at the time of workpiece grinding and of grinding wheel truing.

As shown in FIG. 2, the work head 13 carries a work spindle 20 rotatable about an axis parallel with the slide movement of the traverse table 11. A work head center 21 is fit in one end of the work spindle 20 for carrying one end of the workpiece W. A truing wheel 22 and a dressing roll 23 are fixedly carried on the work spindle 20 in coaxial alignment therewith and in side-by-side or juxtaposed relation with each other. The truing wheel 22 is composed of a steel disc at the circumferential surface of which diamond abrasive grains are bonded in a stratum form and, for the purpose of decreasing truing resistance, is considerably narrower in width than the grinding surface of the wheel 15. The dressing roll 23 is made of metal material of a kind having almost the same hardness, toughness and resistance to wear as refined steel or hardened steel and is a little wider in width than the grinding surface of the grinding wheel 15. The roll 23 is smaller in diameter than the truing wheel 22. One of the truing wheel 22 and the dressing roll 23 which is disposed near the work head center 21, i.e., the dressing roll 23 in this particular embodiment, has secured thereto a drive pin 24 engageable with a workpiece drive dog 36 and thus, acts also as a face plate of the work head 13.

Mounted on the work head 13 is a reversible work drive motor 25, which has a two-stepped drive pulley 27 keyed on an output shaft 26 thereof. This pulley 27 is drivingly connectable through a set of belts 29 with a two-stepped driven pulley 28 keyed on a rear end of the work spindle 20 and is also drivingly connectable through another set of belts 32 with a two-stepped idle pulley 31. This idle pulley 31 is keyed on one end of an intermediate shaft 30 and is in turn connectable with the driven pulley 28 through another set of belts 33. Accordingly, in the case of the workpiece grinding, the rotation of the motor output shaft 26 is transmitted through the drive pulley 27, the belts 32, the idle pulley 31, the belts 33 and the driven pulley 28 to the work spindle 20 to thereby rotate the same at a relatively slow speed. In the case of grinding wheel truing and dressing, on the other hand, the rotation of the motor output shaft 26 is transmitted through the drive pulley 27, the belts 29 and the driven pulley 28 to the work spindle 20 to thereby rotate the same at a relatively fast speed. The intermediate shaft 30 is rotatably carried with a predetermined eccentricity in an eccentric sleeve 34 supported by the work head 13, and the rotational angular position of the sleeve 34 is adjustable in a usual manner for tension adjustment of the belts 33. The motor 25 is adjustable with respect to its mounting position, so that tension adjustment of either of the belts 29 and the belts 32 is also possible.

Further, as shown in FIG. 1, the wheel cover 16 mounts on its upper-front surface a support block 37, on which a bracket 38 is carried for pivotal movement about a pivot shaft 39. The bracket 38 in turn has carried at its free end a stick holder 40 pivotable about a pivot shaft 41, which extends within a plane intersecting the axis of the first mentioned pivot shaft 39. Held by the holder 40 is a stick-like abrasive substance (hereinafter called "grinding stick") 42, which is made of conventional abrasive material such as, for example, aluminum oxide grain and conventional bonding material such as, for example, vitrified bond. A lever 43 secured to the holder 40 is provided for manipulation by the operator to thereby press the grinding stick 42 upon the grinding surface of the wheel 15 over a dressing point where the dressing roll 23 and the wheel 15 face each other with a gap of a predetermined distance. Free abrasive grains that the wheel 15 removes from the grinding stick 42 act as dressing agent to dress the grinding wheel 15 since they fall into the gap established at the dressing point. Usually, the grinding stick 42 is kept at a distance from the grinding surface of the wheel 15 as shown in FIG. 1.

The operation of the apparatus as constructed above will be described hereafter.

In the case of the grinding of the workpiece W, the belts 32 are wound round the drive pulley 27 and the idle pulley 31, and the belts 33 are wound around the idle pulley 31 and the driven pulley 28. Thus, the rotation of the work drive motor 25 in one direction causes the work spindle 20 to rotate at a relatively slow speed in a counterclockwise direction as indicated by the arrow in FIG. 1. The rotation of the work spindle 20 is transmitted to the workpiece W supported between the work head center 21 and a foot stock center, not shown, through the drive pin 24 secured to the dressing roll 23 which acts as a face plate. In this situation, the wheel head 14 is advanced to the position where a slight contact is made between the wheel 15 and the workpiece W, and the intermittent infeed movements by the wheel feed mechanism (not shown), of the wheel head 14 and traverse feed movements by the traverse feed mechanism (not shown), of the table 11 are effected in a well-known manner, whereby the workpiece W is ground with the grinding wheel 15.

Figure 3:
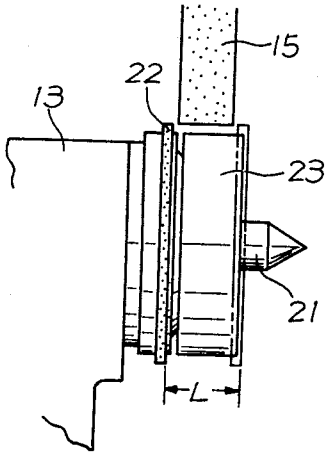
FIG. 3 is an explanatory view illustrative of the relative position between a truing wheel and a grinding wheel during truing.

The repetition of such grinding operations results in the deterioration of the grinding ability of the wheel 15, and the truing and dressing of the wheel 15 becomes necessary. In advance of wheel truing and dressing, the respective sets of the belts 32 and 33 are disconnected from the pulleys 27, 28 and 31, and the belts 29 are wound around the pulleys 27 and 28. The rotation of the motor 25 in one direction in the case of wheel truing causes the truing wheel 22 to rotate together with the work spindle 20 at a relatively fast speed in a counterclockwise direction as indicated by the arrow in FIG. 1, i.e., in the same direction as at the time of workpiece grinding. Coolant is ejected from the nozzle 17 at the same time as the work spindle rotation. Thereafter, the operator's manipulations are executed to move the traverse table 11 toward the right as viewed in FIG. 2 and then to advance the wheel head 14 with the result of positioning the truing wheel 22 at the position where, as shown in FIG. 3, the truing wheel 22 is at the left of the grinding wheel 15 and is given an infeed of a predetermined depth, for example 5*u* against the grinding wheel 15. The traverse table 11 is then moved through a predetermined distance (L) toward the right as viewed in FIG. 3, and this causes the grinding wheel 15 to be trued with the truing wheel 22. This truing is performed with the truing wheel 22 rotating in the same direction as the grinding wheel 15, namely in the manner of upcut truing, and thus, truing resistance can be reduced to thereby precisely true the grinding wheel 15.

Figure 4:
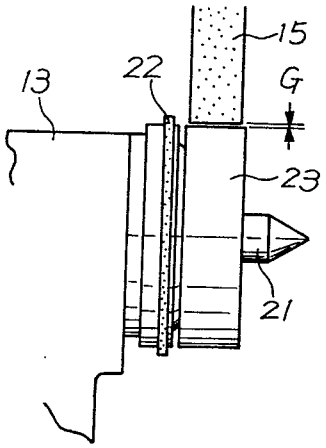
FIG. 4 is an explanatory view illustrative of the relative position between a dressing roll and the grinding wheel during dressing.

Upon completion of the grinding wheel truing, a switching is effected to reversely operate the work drive motor 25 with the result of the dressing roll 23 rotating together with the work spindle 20 in a clockwise direction as viewed in FIG. 1, namely in the opposite direction with respect to the rotational direction of the grinding wheel 15. The traverse table 11 is then moved to bring the dressing roll 23 into alignment with the grinding wheel 15. Further, the wheel head 14 is advanced to the position where a slight contact is made between the dressing roll 23 and the grinding wheel 15 and then, is retracted through a predetermined very-short distance. This establishes a gap (G) of the very-short distance between the dressing roll 23 and the grinding wheel 15 as shown in FIG. 4. When the manipulation by the operator of the lever 43 causes the grinding stick 42 to be pressed upon the grinding surface of the wheel 15, the stick 42 is ground with the grinding wheel 15 and provides free abrasive grains by permitting the separation of the grains therefrom. Due to gravity, these free abrasive grains enter into the gap (G) and, as they are backed up with the dressing roll 23, bite a part of the bond material holding the CBN grains of the wheel 15, thereby cutting the part of the bond material off the remaining bond material. Cutting edges of the CBN grains are protruded from the remaining bond material, so that the dressing of the grinding wheel 15 is accomplished. This dressing is performed with the dressing roll 23 rotating in the opposite direction with respect to the rotational direction of the grinding wheel 15, namely in the manner of down-cut dressing, and thus, the entering of free abrasive grains into the gap (G) established between the wheel 15 and the roll 23 can be accelerated thereby resulting in efficient dressing.

It is to be noted herein that the distance of the gap (G) established between the wheel 15 and the roll 23 is chosen in principal dependence upon the respective mean sizes of the CBN grains and the free abrasive grains. By way of example, in the case where the CBN grains and the free abrasive grains respectively have 110-mesh and 200-mesh means sizes, it is preferred to infeed the free abrasive grains against the CBN grinding wheel 15 to an approximately 0.03 mm. depth when the free abrasive grains pass through the gap (G), and therefore, the distance of the gap (G) is chosen within the range of, approximately 0.04 to 0.05 mm.

Although in this particular embodiment, the free abrasive grains are obtained by pressing the grinding stick 42 upon the grinding surface of the CBN wheel 15 and are supplied toward the gap (G) owing to gravity, it may otherwise be practiced to use free abrasive grains which have been prepared beforehand and to forcibly feed the free abrasive grains toward the gap (G) by a fluid conveyor or an air flow. However, using the grinding stick 42, the dressing efficiency can further be enhanced since the grinding stick 42 also acts to dress the CBN wheel surface by itself when pressed thereupon.

Also, although the truing and dressing operations in the above-described embodiment are carried out with the help of the operator's manual intervention, it is easy for those skilled in the art to automatize the truing and dressing operations.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A grinding machine having a wheel head movable in a first direction and rotatably carrying a grinding wheel made of hard material such as cubic boron nitride, said grinding machine comprising:

a traverse table slidable in a second direction intersecting said first direction;

a work head mounted on said traverse table and supporting a work support shaft;

a drive motor for rotating a workpiece carried by said work support shaft;

a truing wheel coaxially carried on one end of said work support shaft and rotated in the opposite rotational direction with respect to said grinding wheel for truing said grinding wheel;

a dressing roll coaxially carried on said one end of said work support shaft in juxtaposed relation with said truing wheel and rotated in the same direction as the rotational direction of said grinding wheel during dressing for backing up free abrasive grains supplied into a gap between said dressing roll and said grinding wheel;

power transmitting means for transmitting driving power from said drive motor to said truing wheel and said dressing roll;

a grinding stick made of abrasive material and relatively hard bonding material;

a stick holder holding said grinding stick;

a lever provided on said wheel head and positioned for moving said grinding stick toward and away from a grinding surface of said grinding wheel, wherein said grinding stick is positionable into contact with said grinding surface of said grinding wheel at a point wherein free abrasive grains from said grinding stick are movable to said gap;

said grinding stick providing said free abrasive grains between said dressing roll and said grinding wheel by being ground with said grinding wheel when pressed upon said grinding surface of said grinding wheel; and a drive member secured to one of said truing wheel and said dressing roll for transmitting driving power from said power transmitting means to a workpiece carried by said work support shaft, through said one of said truing wheel and said dressing roll.

2. A grinding machine as set forth in claim 1, wherein:

said dressing roll is wider in width than either of said truing wheel and said grinding wheel, is smaller in diameter than said truing wheel and fixedly carries thereon said drive member so as to further act as a face plate of said work head.

* * * * *